United States Patent [19]

Kosmach

[11] Patent Number: 4,604,553

[45] Date of Patent: Aug. 5, 1986

[54] BASELESS INCANDESCENT LAMP

[75] Inventor: Jerry C. Kosmach, Euclid, Ohio

[73] Assignee: General Electric Company, Schenectady, N.Y.

[21] Appl. No.: 635,995

[22] Filed: Jul. 30, 1984

[51] Int. Cl.[4] ..... H01J 5/48

[52] U.S. Cl. ..... 313/315; 313/318

[58] Field of Search ..... 315/315, 318

[56] References Cited

U.S. PATENT DOCUMENTS

| | | | |
|---|---|---|---|
| 620,640 | 3/1899 | Cazin | 313/315 |
| 621,292 | 3/1899 | Cazin | 313/315 |
| 1,940,509 | 12/1933 | Pupala | 313/315 |
| 3,548,243 | 12/1970 | Magherini | 313/318 |

FOREIGN PATENT DOCUMENTS

| | | |
|---|---|---|
| 256718 | 5/1963 | Australia . |
| 53-20918 | 6/1978 | Japan . |

*Primary Examiner*—Harold Dixon

*Attorney, Agent, or Firm*—John P. McMahon; Philip L. Schlamp; Fred Jacob

[57] ABSTRACT

A baseless incandescent lamp having various embodiments all with a single glass unit forming an outer envelope, complementary threads for mating with an electrical socket and an insulative stem is disclosed. The baseless incandescent lamp further comprises a filament rigidly disposed by the insulated stem within the outer envelope and connected between a pair of inner leads. The inner leads are connected to respective outer leads wherein one of the outer leads is connected to at least a portion of the complementary threads by a layer of electrically conductive metal. In one embodiment the other outer lead extends through a central opening of a plastic stem occupying a hollow portion of the outer envelope and is externally and electrically connected to the plastic stem by a layer of the electrically conductive metal.

12 Claims, 10 Drawing Figures

Fig. 9
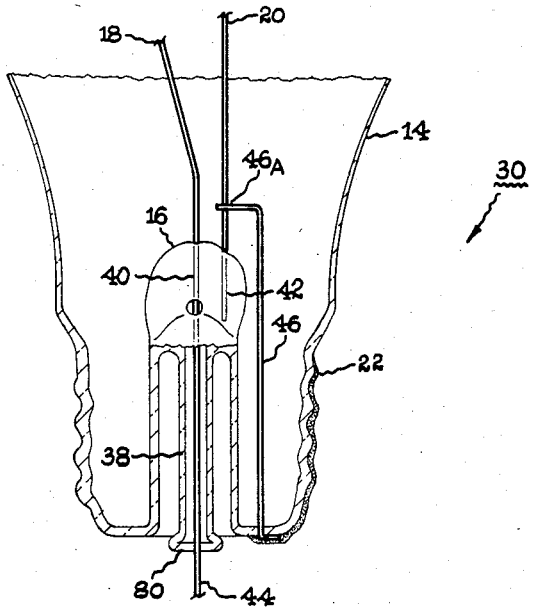
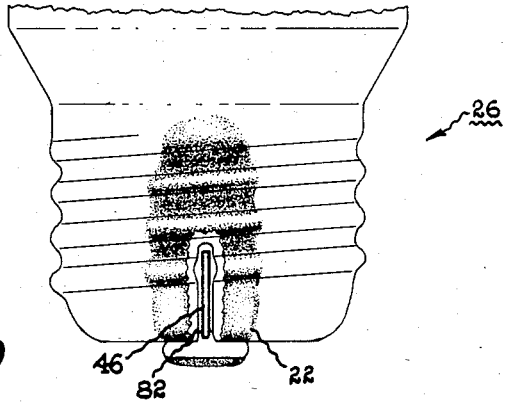
Fig. 10

BASELESS INCANDESCENT LAMP

BACKGROUND OF THE INVENTION

This invention relates to incandescent lamps, and more particularly, to a baseless incandescent lamp wherein complementary mating to an electrical socket is accomplished by threads formed in the incandescent lamp itself.

Incandescent lamps are well-known for providing pleasing illumination and finding applications in millions of homes having existing complementary screw-like sockets for the incandescent lamp. The manufacturers of incandescent lamps, because of the vast quantities produced, are constantly seeking means for reducing the cost of the incandescent lamp itself.

One of the ways of reducing the cost of the incandescent lamp is to eliminate the electrically conductive base of the lamp. Although contributing to the cost of the lamp, the electrical base of the incandescent lamp helps to provide for a well-defined electrical operation of the incandescent filament of the lamp itself. The electrical base formed of metal and having a screw-like arrangement provides for metal-to-metal contact between the base and the socket and thereby good electrical contact for the electrical operation of the incandescent filament of the lamp. The metal base of the incandescent lamp, although having its desired electrical characteristic, is still a cost contributor and it is economically desirable to eliminate the metal base and provide other electrical means for the baseless incandescent lamp to mate with the complementary electrical socket.

An incandescent lamp having an electrically conductive base reduced in size is described in Japanese Utility Model No. 53-20 918 (1.6.78) of Goshi-Kaisha Naka Denki Seisakusho. The Japanese incandescent lamp has a male-threaded portion formed of glass for mating with the female-threaded portion of an electrical socket and integrated with the glass of the incandescent lamp itself. The incandescent lamp has a ring-shaped contact portion located on its lower portion for providing the electrical contact of the incandescent filament with the electrical socket.

It is considered desirable that a baseless incandescent lamp be provided in which the electrical conductive base be further reduced in size and complexity by appropriate means to further reduce the cost and simplify the fabrication both of the lamp while still providing for proper operation of its incandescent filament.

Accordingly, an object of the present invention is to provide a baseless incandescent lamp having electrical means for complementary mating with the electrical socket and which means provides for good electrical contact and proper operation of the incandescent filament.

SUMMARY OF THE INVENTION

The present invention is directed to a baseless incandescent lamp having threads for complementary mating with an electrical socket and formed into the lamp itself.

The baseless incandescent lamp is comprised of a single unit forming the outer envelope, complementary threads for mating with an electrical socket and an insulative stem. The baseless incandescent lamp further comprises a filament rigidly disposed within the outer envelope by the insulative stem and connected between a pair of inner leads which are further connected to respective outer leads. One of the outer leads is connected to at least a portion of the complementary threads by a layer of sprayed particles of an electrically conductive metal, whereas, the other outer lead has means effective for electrically connecting to a center contact of the incandescent lamp.

The features of this invention believed to be novel are set forth with particularity in the appended claims. The invention itself, however, as regards to its structure, may be more readily understood with reference to the following description taken into conjunction with accompanying drawing.

BRIEF DESCRIPTION OF THE DRAWING

FIGS. 6, 7, 8 and 9 are enlarged segmented views which illustrate other various embodiments of the present invention for mating the outer leads to the complementary threads and to the center contact of the incandescent lamp.

FIG. 10 illustrates another embodiment of electrically connecting one of the outer leads to the complementary threads.

DETAILED DESCRIPTION OF THE PREFERRED EMBODIMENT

Figure 1:
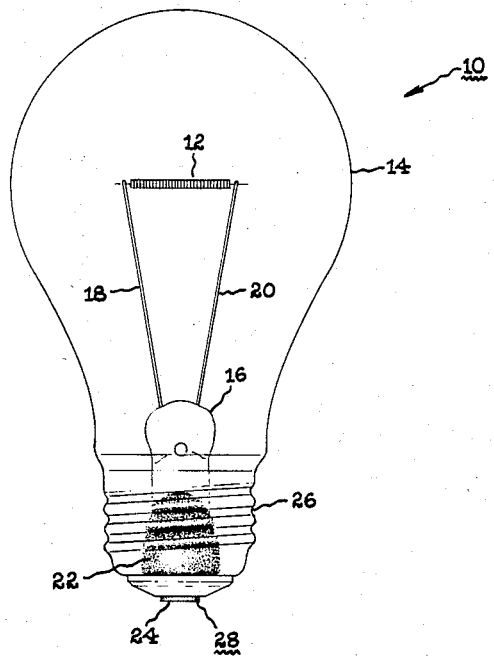
FIG. 1 illustrates a baseless incandescent lamp in accordance with one embodiment of the present invention.

A baseless incandescent lamp 10 in accordance with one embodiment of the present invention is illustrated in FIG. 1. The baseless incandescent lamp comprises a tungsten filament 12 which is rigidly disposed within an outer envelope 14 by an insulative stem 16 and connected between a pair of inner leads 18 and 20. The lamp 10 further comprises layers 22 and 24 of sprayed particles of electrically conductive metals of primary interest to the present invention to be further described hereinafter.

The inner leads 18 and 20 are connected to outer wires (not shown in FIG. 1, but shown in FIGS. 2–10 by reference numbers 44 and 46, respectively), which, in turn, are connected to a screw type thread arrangement 26 and to a center contact 28 of lamp 10. The outer envelope 14, the insulative stem 16 and the screw-type thread arrangement 26 are all of a single unit 30 which is of primary interest to the present invention and is shown in detail in FIG. 2.

Figure 2:
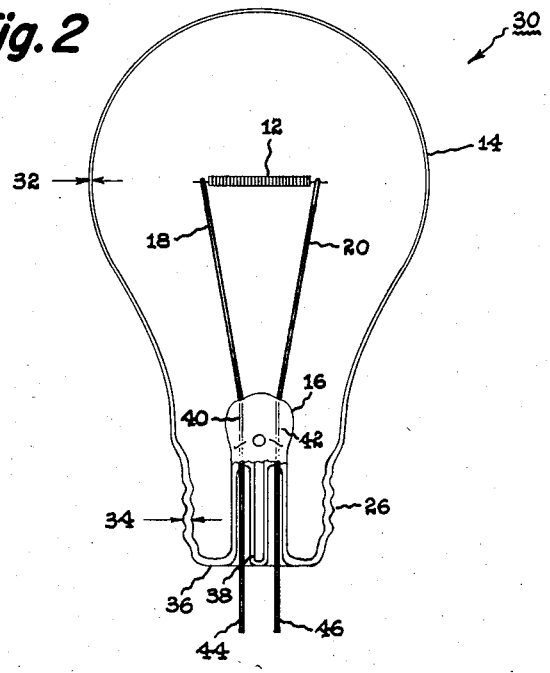
FIG. 2 illustrates a single unit of one embodiment of the present invention comprised of the outer envelope, complementary threads for mating with an electrical socket, and an insulative stem for rigidly mounting the filament of the incandescent lamp of FIG. 1.

FIG. 2 shows the outer envelope 14 as having a thickness 32 which is in the range of about 0.5 mm to about 0.6 mm. The screw-type thread arrangement 26 has a thickness 34 in the range of about 0.6 mm to about 0.7 mm.

The glass stem 16 is comprised of a flare portion 36 and an exhaust tube 38. In one embodiment, the stem 16 preferably has sealed within its confines electrically conductive dumet wires 40 and 42 which respectively connect inner leads 18 and 20 to outer leads 44 and 46. The outer lead 44 is preferably of a steel material, whereas, the outer lead 46 is preferably of a copper material.

Figure 3:
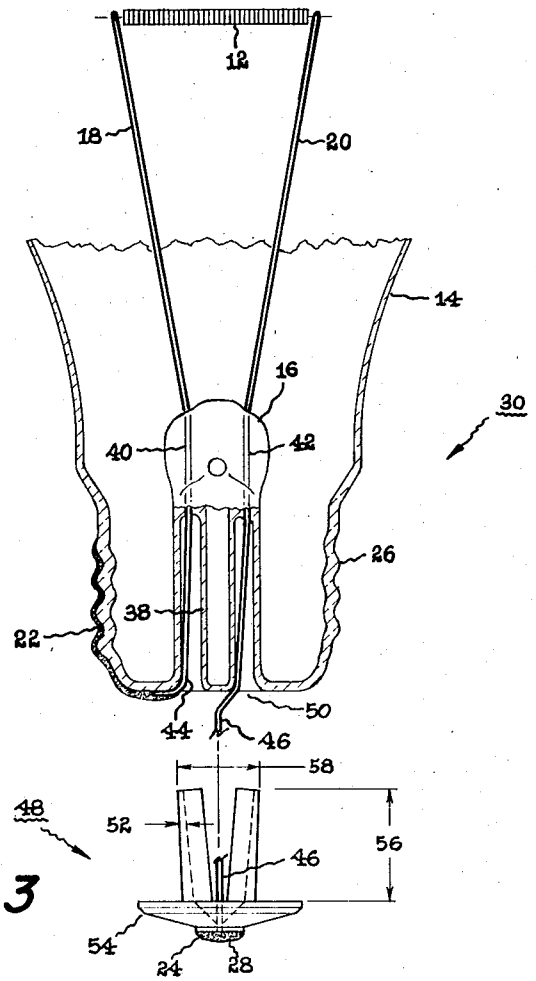

The electrical connections of the outer leads 44 and 46 for one embodiment are shown in detail in FIG. 3. FIG. 3 shows the outer lead 44 as connected to the thread arrangement 26 by the layer 22 of sprayed metal particles, whereas, the outer lead 46, shown in FIG. 3 in a discontinuous manner, is connected to the center contact 28 by the layer 24 of sprayed metal particles. The outer leads 44 and 46 are provided with various embodiments having means effective to electrically connect to the center contact of the baseless incandescent lamp.

The metal layers 22 and 24 of FIG. 3 are formed of a conductive metal such as being commercially available from Tafa Inc., of Bow, NH 03301. The conductive metal layers 22 and 24 may be comprised of aluminum or copper. The metal layers 22 and 24 have a thickness in the range of about 0.05 mm to about 0.1 mm. The conductive metal is applied as a spray to the general area of outer leads 44 and 46 contacting the screw arrangement 26 and center contact 28, respectively. The spray applied to outer lead 44 covers an area in the range of about 15 mm to about 20 mm in width of the contacting screw arrangement 26, whereas, the spray applied to the outer lead 46 completely covers the center contact 28. The metal layers 22 and 24 tenaciously adhere to both the screw arrangement 26 and the center contact 28 even in the presence of a rubbing action.

The metal particles may be applied in the form of a spray by arc guns. The arc sprayed particles have sufficient thermal energy so as these particles impact the surface being sprayed, such as the complementary glass screw arrangement 26, they splatter to form droplets which build up to form the sprayed layers such as metal layer 22. These droplets have sufficient heat energy to melt relatively small spots on the glass and attach to the surface, such as the glass surface of the screw-type configuration 26, in a weld-like fashion.

It has been determined that it is desirable to form the metal layers 22 and 24 by first spraying the associated areas of the screw arrangement 26 and center contact 28 with the metal particles, then to place the respective outer leads 44 and 46 in contact with arrangement 26 and contact 28, and finally applied a second spray to the outer leads 44 and 46. Further, it has been determined that the outer leads 44 and 46, each having an appropriate tin coating, may be soldered to layers 22 and 24, respectively, when the layers 22 and 24 are of a copper material.

In one embodiment, the mating of the center contact 28 to the outer lead 46 is provided by a cylindrical plastic stem 48. The plastic stem 48 is comprised of a thermoplastic material and has a central opening. The plastic stem 48 has an outer wall thickness 52 having a dimension in the range of about 1.0 mm to about 1.5 mm. The stem 48 also has a tapered base 54. The inner walls of the plastic stem 48 have a height 56 in the range of about 14 mm to about 15 mm. The plastic stem 48 further has an outer diameter 58 selected in the range of about 8.36 mm to about 8.41 mm which range is approximately 1 mm larger than the inner diameter of the hollow portion 50 that accommodates the plastic stem 48.

The dimensions and characteristics of the plastic stem 48 are preselected to allow its outer walls to be depressed while being inserted into the hollow portion 50, then allowed to expand to its non-depressed dimension so as to be rigidly affixed and positioning within inner walls of the hollow portion 50 by the spring action of the plastic stem 48 itself.

The mating of the outer lead 46 to the center contact 28 may be accomplished by first passing the outer lead 46 through the central opening of the plastic stem 48, then applying heat by means such as ultrasonic heating to the central area of the plastic stem so as to embed the outer lead 46 to the plastic stem 48, and finally applying the metal layer 24.

Figure 4:
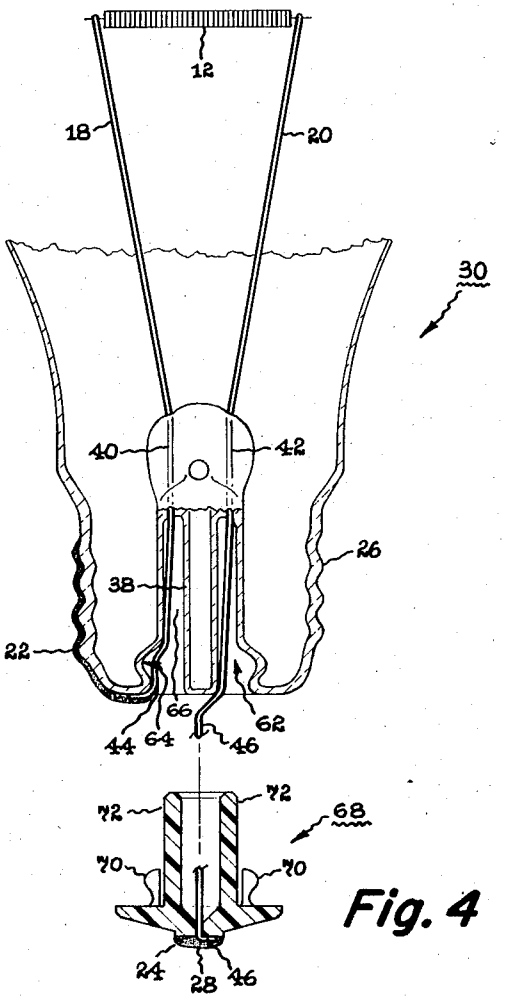
FIGS. 3 and 4 are enlarged segmented views illustrating a first and a second embodiment of the present invention for mating the outer leads to the complementary threads and to the center contact of the incandescent lamp.

Alternate embodiments of electrically connecting the outer leads 44 and 46 to the screw arrangement 26 and center contact 28 are shown in FIGS. 4, 5, 6, 7, 8, 9, and 10. FIG. 4 is similar to FIG. 3 but different in having an inner hollow portion 62 of the single unit 30 with an outwardly curving portion 64 and a relatively straight cylindrical central channel 66. Further, the embodiment of FIG. 4 has a plastic stem 68 selected from the same material as the plastic stem 48 but having complementary dimensions of the hollow portion 62.

The plastic stem 68 has an ear portion 70 and a stem portion 72 which upon the insertion of plastic stem 68 into the hollow portion 62 causes the ear 70 to abut up against the outwardly curved portion 64 and causes the stem 70 to be lodged into the central channel 66. The ear 70 and the stem 72 are advantageous in holding the outer lead 44 against the outward portion 64 and the outward wall of channel 66 so as to assist in maintaining the electrical connection of the outer lead 44 to the screw arrangement 26.

Figure 5:
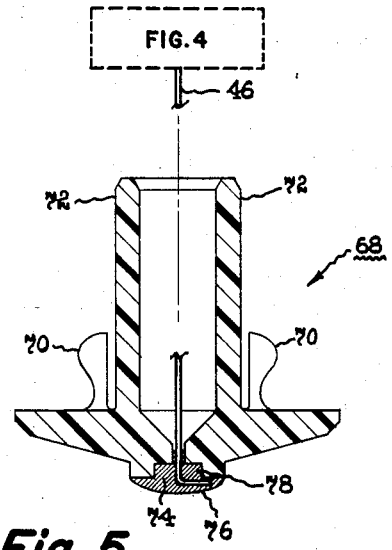
FIG. 5 illustrates one embodiment of providing a solder connection for the center contact of the incandescent lamp of the present invention.

The outer lead 46 may be also mated to the plastic stem 68 or to the plastic stem 48 by a layer of solder 74 which forms a center contact 76 shown in FIG. 5. To accomplish such mating, it is preferred that the plastic stems 68 and 48 of FIGS. 4 and 3, respectively, be provided with a cavity or pot 78 shown in FIG. 5. The solder pot 78 holds the outer wire 46, having an appropriate tin coating, within the confines of the plastic stem 68 or 48. The layer of solder 74 within solder pot 78 and also on top of external tip of the plastic stem 68 or 48 forms the center contact 76 for the baseless incandescent lamp 10 of the present invention.

Figure 6:
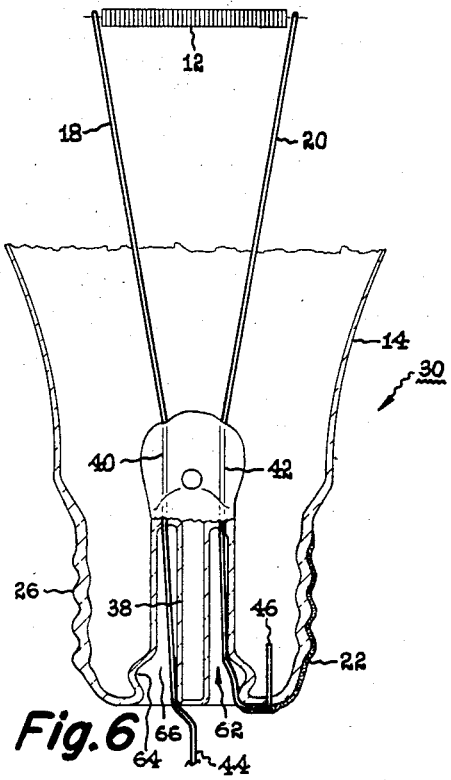

Another embodiment of the present invention is shown in FIG. 6 which is similar to FIG. 4 but differs in that the end portion of outer lead 46 is located within the single unit 30 at the location of the screw arrangement 26. The outer lead wire 46 is placed into and sealed within the single unit 30 during the molding process.

The outer lead wire 46 is selected to have a coefficient of expansion in the range of about 80 to about 100 inch per linear inch of wire 24 given in degrees $C°10^{-7}$. This coefficient for the outer lead 46 provides for proper sealing of the glass screw arrangement 26 during the molding process of the single unit 30. The sealing of outer lead 46 within the single unit 30 further assists in maintaining the desired electrical contact of the outer lead 46 to the metal layer 22.

Figure 7:
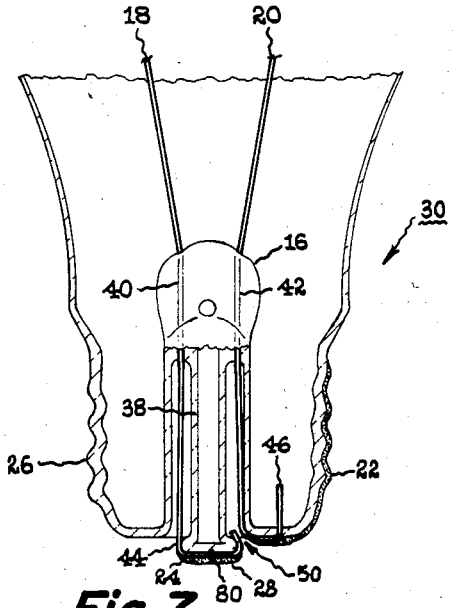

A further embodiment is shown in FIG. 7 primarily illustrating the bottom portion of the single unit 30. FIG.7 is similar to FIG. 6 but differs in the structure of the center contact 28 and has the outer lead 44 mating with center contact 28. The means effective to electrically connect the outer lead 44 or also outer lead 46 to the center contact 28 is provided without the need of either of the plastic stem 48 or 68.

The structure of center contact 28 of FIG. 7 is accomplished by extending the length of exhaust tube 38 during the tipping process so that its outward tip 80 contacts the complementary portion of the electrical socket when lamp 10 is so inserted. The outer wire 44 is embedded into the softened and mushroom end of exhaust tube 38 and its end portion is positioned into the confines of the hollow portion 50.

Figure 8:
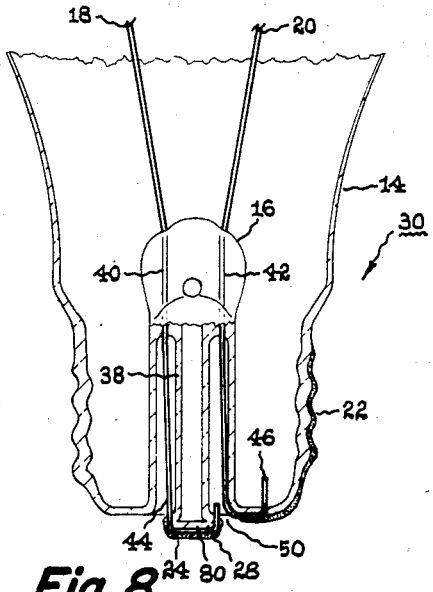

A still further embodiment is shown in FIG. 8 which is similar to FIG. 6 but differs in the structure of the center contact 28. The outer lead 44 is intertwined within the outer tip 80 of the exhaust tube 38. The outer lead 44 is interwined into the tip 80, then out to the external portion of tip 80, back into the tip 80, finally out of the tip 80, and then the end portion of the outer lead 44 is placed into the confines of the hollow portion 50. The intertwining is accomplished after the tipping process of the exhaust tube 38 and while the exhaust tube 38 is softened and has its mushroom shape. The outer lead 44 is selected to have a coefficient of expansion as that of outer lead 46 discussed with regard to FIG. 6. The intertwining of the outer lead 44 into the tip 80 assists in maintaining good electrical contact between the outer wire 44 to the metal layer 46.

Another embodiment is shown in FIG. 9 which is similar to FIG. 6 but differs in having the outer lead 22 passing through the inner chamber of exhaust tube 38 and sealed in the tip portion 80. The outer lead 44 may be mated to form center contact in a manner as described for either FIG. 3, 4, 5, 7 or 8. Further the outer lead 46 covered by the metal layer 22 does not connect to the dumet member 42 but is connected at location $46_A$, to inner lead 20 by means of welding or clamping.

The outer lead 46 may also be mated to the metal layer 22 by a wire recess groove 82 shown in FIG. 10. The wire recess groove 82 is formed as a part of screw arrangement 26 and provides a channel for the outer lead 24 to be located so as not to come into physical contact with a mating electrical socket as the incandescent lamp is screwed into the socket.

Although FIG. 10 shows the metal layer 22 as having a preferred width with the dimensions previously given of about 15 mm to about 20 mm and also the layer 22 as substantially covering the screw arrangement 26 from its top to its bottom, it should be recognized that the practice of this invention contemplates that metal layer 22 need only be applied to cover and tenaciously adhere the outer lead 46 to the screw arrangement 26 so as to provide a good and a reliable electrical connection for outer lead 46.

The electrical connections provided for the outer leads 44 and 46 for all embodiments are of primary importance to the present invention. An incandescent lamp of the present invention was screwed into a household type socket, energized and successfully operated for a period in excess of 240 hours (10 days), after which period the excitation was then removed.

Accordingly, the present invention provides for a proper electrical contact for the outer leads 44 and 46, which, in turn, advantageously provide for proper operation of the incandescent lamp.

It should now be appreciated, that proper electrical connection for lamp 10 is accomplished without the need of any prior art electrically conductive base. It should be further appreciated, that layers, such as 22 and 24, of sprayed particles of electrically conductive material provide the lamp 10 with appropriate means that reduce the size and complexity, relative to prior art devices, of the electrical mating of lamp 10, with complementary electrical sockets while still providing proper operation of its incandescent filament.

It should now be further appreciated that the present invention provides for a baseless incandescent lamp not having an electrically conductive base, but having various embodiments of appropriate means for providing proper connection of the lamp 10 when the lamp is placed into its intended environment of an electrical device.

What I claim as new and desire to secure by Letters Patent of the United States is:

1. An incandescent lamp devoid of an electrically conductive base and comprising a single unit which forms; (1) an outer envelope; (2) complementary threads for mating with an electrical socket; and (3) an insulative stem, said lamp further comprising a filament rigidly disposed within said outer envelope by said insulative stem and connected between a pair of inleads, said inleads being connected to respective outer leads, one of said outer leads being electrically connected to at least a portion of said complementary threads by a layer of sprayed particles of electrically conductive material, wherein said single unit has a central hollow portion and means effective to electrically connect the other outer lead to a center contact comprising:

(a) a cylindrical stem member formed of thermoplastic material and having selected complementary dimensions of said hollow portion effective to be inserted into and rigidly lodged within said hollow portion; and (b) a layer of said electrically conductive material covering said other outer lead and providing electrical contact of said other outer lead to a complementary portion of an electrical socket when the baseless incandescent lamp is so inserted.

2. An incandescent lamp according to claim 1 wherein said layer of electrically conductive metal has a thickness in the range of about 0.05 mm to about 0.1 mm.

3. An incandescent lamp according to claim 2 wherein said layer of electrically conductive metal is comprised of sprayed particles and is selected from the group consisting of aluminum and copper.

4. An incandescent lamp according to claim 1 wherein said thermoplastic stem member has an outer diameter dimension selected to exceed the inner wall dimension of said hollow portion by about 1.0 mm.

5. An incandescent lamp according to claim 4 wherein said thermoplastic stem member has an outer wall with a thickness in the range of about 1.0 mm to about 1.5 mm and a height of about 14 mm to about 15 mm.

6. An incandescent lamp according to claim 1 wherein said hollow portion has an outward curved lower portion and a relatively straight cylindrical central channel, said thermoplastic stem portion having an ear portion and a central portion having dimensions respectively selected to be somewhat greater than said outward curved portion and said relatively straight cylindrical central channel.

7. An incandescent lamp according to claim 1 wherein said single unit has a central hollow portion and said means effective to electrically connect said other outer lead to said center contact comprises:

(a) a cylindrical stem member formed of thermoplastic material and having selected complementary dimensions of said hollow portion effective to be inserted into and rigidly lodged within said hollow portion, said stem member further having a central cavity in its base portion; and (b) a layer of solder joined to the portion of the other outer lead located in said cavity and covering said other outer lead located on the tip portion of said thermoplastic stem member, said layer of solder providing electrical contact of said outer lead to a complementary portion of an electrical socket when said baseless incandescent lamp is so inserted.

8. An incandescent lamp according to claim 1 wherein said outer envelope has a wall thickness in the range of about 0.5 mm to about 0.6 mm and said complementary threads has a thickness of about 0.6 mm to about 0.7 mm.

9. An incandescent lamp according to claim 1 wherein said layer of electrically conductive metal has a thickness in the range of about 0.05 mm to about 0.1 mm.

10. An incandescent lamp according to claim 9 wherein said layer of electrically conductive metal is comprised of spray particles and is selected from group consisting of aluminum and copper.

11. An incandescent lamp according to claim 1 wherein at least one of said outer leads has at least a portion of its outermost region sealed within said single unit.

12. An incandescent lamp according to claim 1 wherein at least one of said outer leads has at least a portion of its outermost region lodged in a wire recess grtoove formed in the complementary threads of said single unit.

* * * * *